United States Patent [19]

Rabe

[11] Patent Number: 4,846,895

[45] Date of Patent: Jul. 11, 1989

[54] REMOTELY OPERATED ROTARY TUBE CLEANING SYSTEM AND METHOD

[75] Inventor: George B. Rabe, Sparta, N.J.

[73] Assignee: Foster Wheeler Energy Corporation, Clinton, N.J.

[21] Appl. No.: 73,312

[22] Filed: Jul. 10, 1987

Related U.S. Application Data

[63] Continuation of Ser. No. 802,810, Nov. 29, 1985, abandoned.

[51] Int. Cl.[4] ..... B08B 7/00; B08B 13/00

[52] U.S. Cl. ..... 134/22.11; 15/3.5; 15/3.51; 15/104.02; 15/104.03; 15/104.09; 15/104.13; 15/104.15; 15/104.16; 15/104.17; 15/104.31; 134/8; 134/9; 134/14

[58] Field of Search ..... 134/8, 9, 14, 15, 22.1, 134/22.11; 15/104.2, 104.02, 104.09, 3.5, 3.51, 104.13, 104.15, 104.16, 104.17, 104.31

[56] References Cited

U.S. PATENT DOCUMENTS

| | | | |
|---|---|---|---|
| 650,451 | 5/1900 | Byers | 15/104.2 |
| 1,133,262 | 9/1915 | Casaday | 15/104.13 |
| 1,145,230 | 7/1915 | Fuller | 15/104.13 |
| 2,257,448 | 9/1941 | Baker | 15/104.13 |
| 2,517,227 | 8/1950 | O'Leary | 15/104.09 |
| 2,631,113 | 3/1953 | O'Brien | 134/8 |
| 2,631,114 | 3/1953 | O'Brien | 134/8 |
| 4,011,100 | 3/1977 | Ross | 134/8 |
| 4,337,096 | 6/1982 | Clifford | 15/104.31 |

*Primary Examiner*—Asok Pal

*Attorney, Agent, or Firm*—Marvin A. Naigur; Martin Smolowitz

[57] ABSTRACT

A rotary tube cleaning system having a rotary cutting tool attached to an elongated flexible drive wire for remotely cleaning the inside of elongated tubes, and method for its use. The tube cleaning system includes a special rotary cutting tool rigidly attached to an elongated flexible drive wire, which are rotatably driven through a slip clutch by variable speed rotary drive means. The tool has dual oppositely-facing cutting edges at its forward end and also has dual longitudinally separated cylindrical guide surfaces provided at the tool forward and rear ends. In the method for remotely cleaning the tubes using the rotating cutting tool, the tool is inserted into a thimble tube, rotated at 150–250 rpm and fed forward at 5–20 ft/min to cut or scrape any deposits from the inner wall of the tube. The tool is then removed and similarly inserted into other tubes in sequence to scrape and substantially remove accumulated material therein.

10 Claims, 3 Drawing Sheets

ZONE B
ZONE A
21
20
16a
17
14
19
16
18
15
15a
16b
10
13
12

REMOTELY OPERATED ROTARY TUBE CLEANING SYSTEM AND METHOD

This application is a continuation of application Ser. No. 802,810, filed 11/29/85, now abandoned.

BACKGROUND OF INVENTION

This invention pertains to a rotary tube cleaning system and method for remotely cleaning the inside of elongated small diameter tubes. It pertains particularly to such a tube cleaning system and method for remotely cleaning small diameter thimble tubes such as those used in reactors of nuclear power plants.

During operation of nuclear reactors, it is necessary to periodically monitor the level of radioactivity existing in the core of the reactor. For this purpose, a series of thimble tubes are provided which extend from a convenient external location into the reactor. These thimble tubes are closed at their inner or reactor ends and are open at their inlet ends to provide for insertion of a nuclear monitoring probe device into the reactor for measuring radioactive flux throughout the reactor core. It has been found that over time undesirable deposits can form in these small diameter thimble tubes and interfere with passage of the probe device into the reactor. To correct this serious problem without disassembly of the probe tubes, which are highly radioactive, a remotely operated tube cleaning device is needed for removing the undesired deposits in the thimble tubes. However, because of the relatively small inner diameter of the tubes (0.20–0.25 inch) and remote location of the blockages, e.g. about 85 feet from the thimble tube open end, and the radioactive environment which is involved, such tube cleaning operation is dificult to accomplish reliably and safely. Thus, a suitable solution to this tube blockage problem by using a remotely operated rotary tube cleaning system and method has been needed in the nuclear power industry.

Some devices and systems for remote cleaning of tubes by rotary devices have been developed and disclosed in the prior art. For example, U.S. Pat. No. 2,679,061 to Baker discloses a rotary tube cleaner having a tool attached to the end of a flexible hollow shaft driven by a motor and arranged for flow of a cooling liquid through a casing surrounding the shaft. U.S. Pat. No. 3,354,490 to Masters et al discloses a boiler tube cleaning apparatus using a scraper brush attached to a flexible shaft and fed forward by a positioned ejector unit. Also, U.S. Pat. No. 4,326,317 to Smith et al discloses a rotary tube cleaning apparatus for use in cleaning and flushing heat exchanger tubes of nuclear steam generators. However, because of the deficiencies associated with the known prior art, an improved tube cleaning system and method for remotely cleaning out deposits from long small diameter tubes is needed, and have been developed and provided by the present invention.

SUMMARY OF INVENTION

This invention provides a rotary tube cleaning system and method for remotely cleaning the interior of small diameter elongated tubes, such as the curved thimble tubes of a nuclear reactor. The tube cleaning system comprises a rotary cutting tool having at least one cutting edge located at its forward end and is connected at its rear end to an elongated flexible wire drive shaft, with the tool preferably having dual oppositely-facing cutting edges at its forward end. The rotary cutting tool is also provided with dual longitudinally separated cylindrical guide surfaces located at its forward and rear ends for guiding the tool within a tube being cleaned. The flexible wire drive shaft and attached cutting tool are rotated by a special rotary slip clutch device attached to a rotary drive means, such as an electric motor, operatively attached to the slip clutch. The slip clutch is adapted for rotating the drive wire and attached cutting tool at a desired rotary speed, which is usually at 100–250 rpm range, while simultaneously feeding the flexible drive wire forward in the tube. The slip clutch device also allows the rotary drive means for the drive wire to become disengaged from the wire whenever any appreciable or excessive obstruction is encountered by the cutter and/or flexible wire within the elongated thimble tube, so as to limit the applied torque and avoid any excessive twisting of the drive wire beyond its elastic limit.

The cutting tool and elongated flexible drive shaft or wire are fed through a guide tube and the slip clutch and then through the open end of the elongated thimble tube. The cutting tool is provided with dual longitudinally separated guiding surfaces, which have outside diameters slightly smaller than the inner diameter of the thimble tubes, which is usually 0.20–0.35 inch and not exceeding about 0.50 inch inner diameter. The tool preferably has two oppositely directed cutting edges at its forward end separated by a centering point. The cutting tool rear end is rigidly attached to the flexible wire shaft, which wire is 0.10–0.150 inch diameter, and is usually 70–100 feet long. The elongated thimble tube can have one 90 degree sweep bend through which the cutting tool and connected flexible drive wire are inserted.

The present invention also provides a method for remotely and rotatably cleaning the inside of elongated small diameter tubes, such as thimble tubes for nuclear reactors. The tube cleaning method includes inserting a special rotary cutting tool attached to an elongated flexible drive wire through a rotary slip clutch and into the elongated thimble tube; gripping the wire with the clutch which is rotatably attached to a rotary drive means and thereby rotating the drive wire and cutting tool; and feeding the rotating drive wire and attached cutting tool forwardly through the slip clutch and tube and thereby cutting and removing any accumulated deposits from the inner surface of the tube.

It is an advantage of the present invention that remotely located accumulated deposits within small diameter thimble tubes of nuclear reactors are conveniently and reliably removed from the elongated tubes in remote radioactive zones, by inserting and operating the rotary cutting tool and drive wire from an area of low level radioactivity usually near the reactor.

BRIEF DESCRIPTION OF DRAWINGS

This invention will be further described by reference to the following drawings, in which.

DESCRIPTION OF INVENTION

Figures 1, 1A:
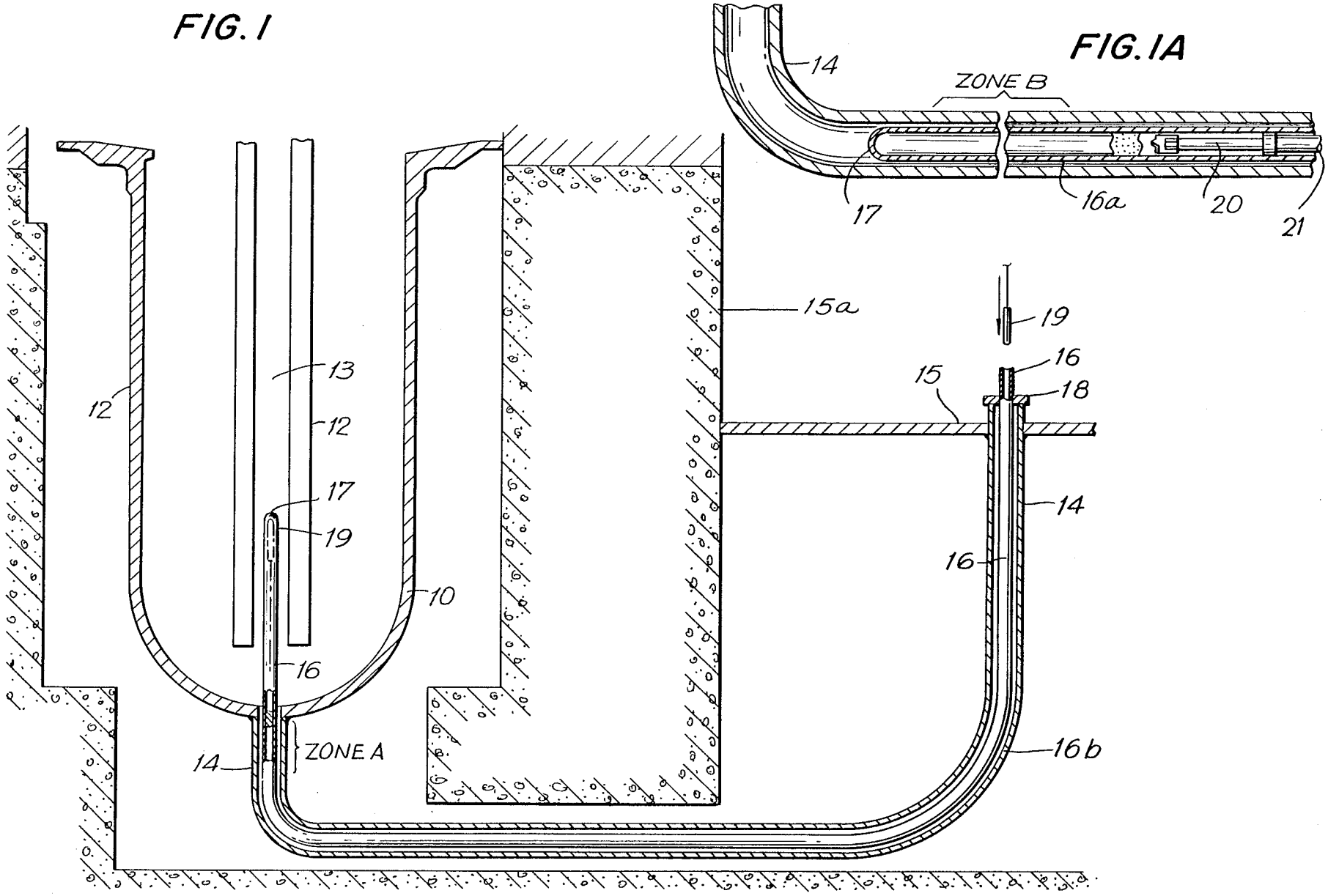
FIG. 1 shows a schematic sectional elevational view of a nuclear reactor containing fuel elements and with a conduit containing a thimble tube connected to the lower end of the reactor for remote rotary cleaning of the thimble tube in accordance with the invention.
FIG. 1A is a fragmentary section view of the conduit of FIG. 1, showing the thimble tube partly withdrawn to a location in the horizontal leg of the conduit to facilitate rotary cleaning of the thimble tube.

One useful embodiment of this invention is described by reference to FIG. 1. As generally shown in FIG. 1, a remotely-located reactor vessel 10 such as used in a nuclear power plant contains multiple nuclear fuel elements 12 for heating water to generate steam. For successful operation of the power plant, it is necessary to periodically monitor the performance of the reactor. For this purpose, several conduits 14 are provided extending from an operating floor 15, adjacent but radioactively shielded by wall 15a from the reactor, to the vessel of the reactor 10. An elongated thimble tube 16 having a closed inner end 17 is inserted through each conduit 14 into the reactor to locations between adjacent fuel elements 12. The outer end of thimble tube 16 is sealed pressure-tightly to the conduit 14 by a temporary sealing device 18, such as an adjustable split-ring sealing device, which is adapted to permit the thimble tube 16 to be moved axially relative to the conduit 14. A suitable split-ring sealing device 18 is disclosed by my co-pending patent application entitled "Split Ring Sealing Device for High Pressure Service", Ser. No. 643,579 filed Aug. 23, 1984, now abandoned.

Whenever it is desired to check the level of radioactivity in the reactor 10, a probe device 19 is passed through the thimble tube 16 to its end 17 where it is placed between the adjacent fuel elements 12 and where the radioactivity level is measured to determine the performance of the reactor. However, it has been found that undesired deposits accumulate within the thimble tubes 16 and must be removed periodically to permit passage of the probe 19 through the thimble tubes for continued monitoring and safe operation of the reactor.

Whenever it is desired or necessary to clean a thimble tube 16 to remove such accumulated deposits and permit inserting the probe 19, a special rotary cutting tool 20 and attached flexible drive wire 21 are inserted into the thimble tube 16 and the tool is fed through the tube until the blockage is encountered. Any blockage which exists in the thimble tube 16 is removed by passing the rotating cutting tool 20 through the tube 16 and scraping the inner walls of the tube.

Figure 2A:
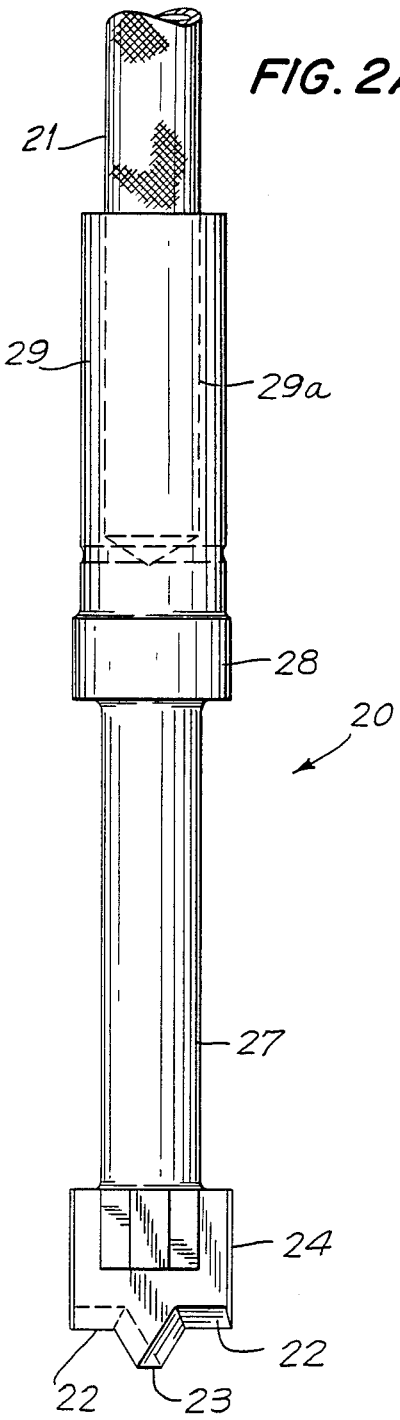
FIGS. 2A, 2B and 2C show two longitudinal views and one end view of the special rotary cutting tool and drive wire which are inserted into an elongated thimble tube for cleaning the inner surfaces of the tube.
Figure 2B:
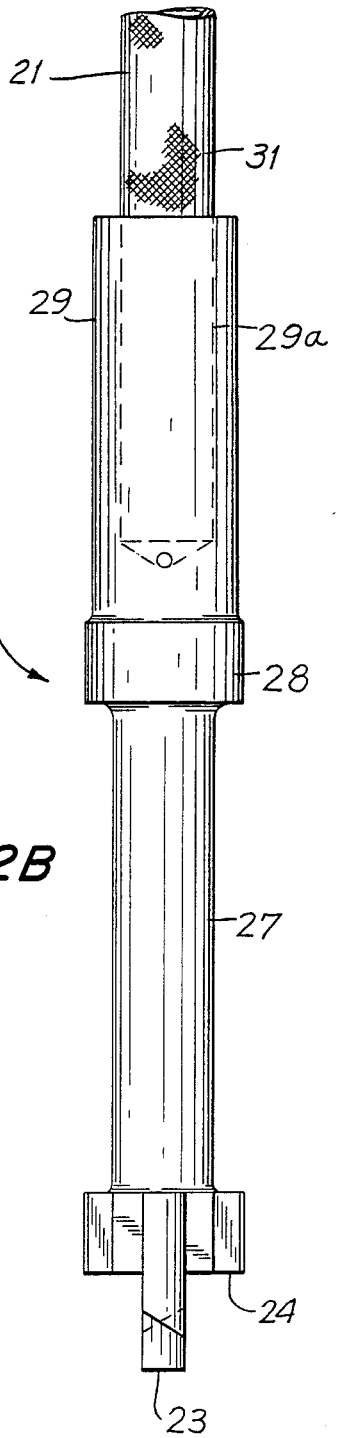
Figure 2C:
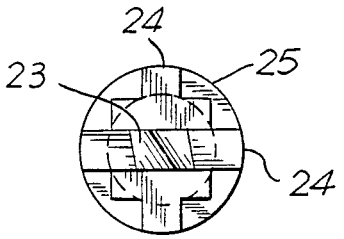

As shown by FIGS. 2A and 2B, the rotary cutting tool 20 has a flexible drive wire 21 rigidly attached to the rear end of the cutting tool. The rotary cutting tool 20 has at its front end dual cutting edges or surfaces 22 separated by a center triangular-shaped cutting surface 23. Located adjacent to the cutting surfaces 22 are four front radially-oriented guide fingers 24 the outer surfaces of which define a cylindrical surface 25, as best shown by end view FIG. 2C. The cutting tool 20 also has a rear cylindrical-shaped guide surface 28, separated longitudinally from the front guide fingers 24 by intermediate shank portion 27 having a reduced diameter relative to the rear cylindrical guide surface 28. The cutting tool 20 is rigidly attached at rear sleeve portion 29 onto the elongated flexible drive wire 21, such as by brazing at joint **29*a*. The flexible drive wire 21 is usually at least about 50 feet long and can be up to about 100 feet long if necessary. The drive wire has a diameter of 0.10–0.15 inches, and is preferably coated with a low-friction coating material 31, such as graphite or a smooth plastic material such as nylon, polyethylene, or polytetrafluoroethylene (Teflon), to facilitate rotation of the flexible drive wire and cutting tool within the thimble tube 16**.

Figure 3:
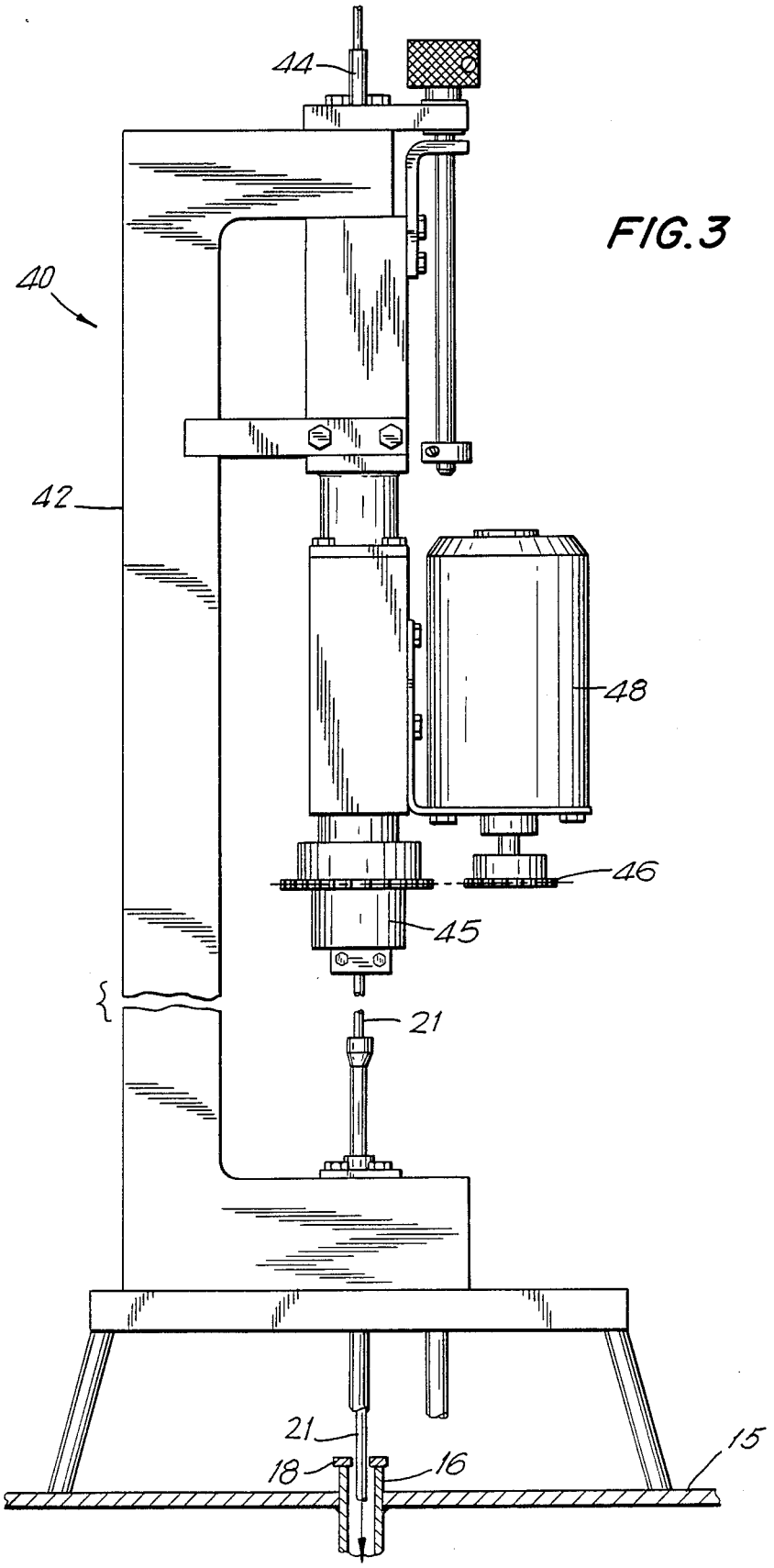
FIG. 3 shows a drive motor and rotary slip clutch means for rotating the drive wire and cutting tool and for feeding them forward into the thimble tube for remotely cleaning the tube in accordance with the invention.

The cutting tool 20 and elongated flexible drive wire 21 are rotatably driven by special drive means 40 located above the operating floor 15, as is shown by FIG. 3. The drive means 40 includes a frame 42 having an attached guide tube 44 located at its upper end. The cutting tool 20 and drive wire 21 are rotated by a slip clutch 45, which is driven by chain drive means 46 and electric motor 48, which will usually have variable speed. Whenever any appreciable obstruction is encountered in the thimble tube 16 by the cutting tool 20, the slip clutch 45 allows the rotary drive means 40 to become at least partly disengaged from the flexible drive wire 21, so as to limit the applied torque and avoid any excessive twisting of the drive wire beyond its elastic limit. For good results, the drive wire 21 and tool 20 are usually rotated at about 100–250 rpm, and preferably at about 200 rpm, while the slip clutch simultaneously feeds the flexible drive wire and attached cutting tool forward into the thimble tube 16.

As the cutting tool 20 is inserted into each thimble tube 16 leading to the reactor vessel 10, it is preferably first guided into the selected thimble tube by the guide tube 44, which is located above the rotary drive means and is supported by frame 42 of the drive machine 40. As shown by FIG. 1, blockages in the thimble tubes 16 usually occur at a zone A near where the thimble tube enters the lower end of the reactor 10. In this circumstance, the flexible rotating drive wire 21 will usually encounter excessive friction in passing through the two 90-degree bends for thimble tube 16. Therefore, the thimble tube 16 is withdrawn out of guide tube 14 sufficiently that the blocked portion of tube 16 is located in the lower portion (zone B) as is shown by FIG. 1A. Such partial withdrawal of the thimble tube 16 to position **16*a*, as shown in FIG. 1A, permits the rotary tool 20 and flexible drive wire 21 to be operated freely by passing through only one 90-degree bend at 16*b* and without any binding or jamming in the tube 16**.

In the method of the present invention for remotely and rotatably cleaning the elongated thimble tubes, the cutting tool 20 and drive wire 21 are first inserted into a selected thimble tube 16 by passing them through the guide tube 44, and then through the slip clutch 45 and into the thimble tube 16. When the blockage is encountered in the tube 16, the drive wire 21 is clamped by the clutch 45 and the motor 48 is started. The cutter tool 20 is rotated at the desired speed usually about 200 rpm, and the tool is advanced forward in the thimble tube at 5–20 ft/min to provide desired tube cleaning results. The drive wire and cutting tool are then withdrawn and inserted into another thimble tube containing blockage or deposits and the rotary cleaning procedure is repeated until all the thimble tubes have been cleaned.

This invention will be better understood by reference to the following typical example of operations, which should not be construed as limiting the scope of the invention.

EXAMPLE

In a nuclear reactor having several thimble tubes inserted between fuel elements from the lower end of the reactor, some of the thimble tubes developed undesired deposits which prevented proper entry of neutron monitor probes for measuring the radio-activity level of the reactor. Such deposits have been removed in accordance with the invention, by inserting into the thimble tubes a rotary cutting tool attached to an elongated flexible drive wire. The tool is rotated by a rotary drive motor through a slip clutch located on the operating floor adjacent the nuclear reactor and radioactively shielded from the reactor. The rotary cutting tool is inserted into the thimble tube past a 90-degree bend to a horizontal portion and scrapes the inner surface of the thimble tube to remove the accumulated deposits in the tube.

Typical dimensions and parameters used for the rotary cutting tool and thimble tube cleaning system are as follows:

Thimble tube length, ft.: 90
Thimble tube inner dia., in.: 0.210
Flux probe outer dia., in.: 0.18
Cutter outer dia., in.: 0.196
Drive wire dia., in.: 0.120
Drive wire length, ft.: 80
Cutter rotary speed, rpm: 200
Tool feed rate, ft/min: 8–10

Although the present invention has been described broadly in terms of a preferred embodiment, it will be understood that modifications and variations can be made within the scope of the invention which is defined by the following claims.

I claim:

1. A rotary tube cleaning system for remotely cleaning the interior of elongated curved tubes, comprising:

(a) a cutting tool having forward and rear ends, each said end being provided with cylindrical guide surface longitudinally separated by an intermediate portion having a reduced diameter relative to the diameter of each said cylindrical guide surface, said cutting tool having dual cutting edges separated by a central point cutting surface located at the tool forward end adjacent the front guide surface;

(b) an elongated flexible drive wire rigidly attached to the rear end of said cutting tool;

(c) a rotary slip clutch having a central opening through which said cutting tool drive wire are passed and can be rotated with limited torque applied by the slip clutch and fed forward into an elongated curved tube being cleaned; and (d) rotary drive means operatively attached to said slip clutch for rotating the slip clutch and said flexible drive wire and said cutting tool in the elongated tube, whereby the drive wire and cutting tool can be rotated with the limited/applied/ torque applied by the slip clutch and fed forward in the tube to rotatably scrape and clean the interior surface of the tube at a remote location.

2. A tube cleaning system according to claim 1, wherein said cutting tool front end cylindrical shoulder guide surface is provided by four radially-oriented fingers for guiding the cutting tool within the tube being cleaned.

3. A tube cleaning system according to claim 1, wherein said flexible drive wire is steel alloy and covered with a plastic coating, said wire having a diameter of 0.10–0.16 inches.

4. A tube cleaning system according to claim 1, including a guide tube attached to said rotary drive means before said rotary slip clutch, wherein said cutting tool and flexible drive wire are inserted through the guide tube and into an elongated thimble tube extending into a nuclear reactor vessel, said thimble tube having an inner diameter not exceeding about 0.50 inch and containing at least one 90° angle bend.

5. A tube cleaning system according to claim 1, wherein said rotary slip clutch limits torque applied to said flexible drive wire and becomes at least partly disengaged from said flexible drive wire, and thereby avoids twisting the drive wire beyond the elastic limit of the drive wire, whenever any obstruction is encountered in the tube being cleaned.

6. A rotary tube cleaning system for remotely cleaning the interior of an elongated /surved/ curved tube, comprising:

(a) a cutting tool having forward and rear ends, each said end being provided with a cylindrical guide surface longitudinally separated by an intermediate shank portion having a reduced diameter relative to the diameter of each said cylindrical guide surface, said cutting tool having at said forward end dual oppositely-facing blade edges separated by a central point cutting surface located adjacent the front guide surface, said front guide surface being provided by four radially-oriented fingers for centrally guiding the cutting tool within the tube being cleaned;

(b) an elongated flexible drive wire rigidly attached to the rear end of said cutting tool, said wire being coated with a low friction coating material;

(c) a rotary slip clutch device having a central opening through which said cutting tool and drive wire are passed and can be rotated with limited torque applied by the slip clutch and fed forward into an elongated curved tube being cleaned; and (d) rotary drive means operatively attached to said slip clutch device and a guide tube attached to said rotary drive means before said rotary slip clutch for rotating said slip clutch device and said flexible drive wire and said attached cutting tool in the elongated tube, whereby the drive wire and cutting tool can be rotated with the limited torque applied by the slip clutch and fed forward in the tube to rotatably scrape and clean the interior surface of the tube at a remote location.

7. A method for rotatably cleaning elongated curved tubes at a remote location, comprising:

(a) inserting a cutting tool and attached flexible drive wire through a guide tube and then through a rotary slip clutch into an elongated curved tube to be cleaned;

(b) gripping said wire with said rotary slip clutch and thereby rotating said wire and cutting tool within the tube; and (c) feeding the rotating wire and attached cutting tool forwardly with limited torque into the elongated tube being cleaned and thereby cutting and removing deposits from the inner surfaces of the tube.

8. A tube cleaning method according to claim 7, wherein said clutch and drive wire are rotated at 150–250 rpm.

9. A tube cleaning method according to claim 7, wherein said elongated tube is a thimble tube of a nuclear reactor, and said tube is partially withdrawn from the reactor before inserting the cutting tool and drive wire into the tube.

10. A method for remotely and rotatably cleaning elongated curved thimble tubes of a nuclear reactor, comprising:

(a) partially withdrawing an elongated thimble tube from a nuclear reactor and inserting a rotary cutting tool and attached flexible drive wire through a guide tube and then through a rotary slip clutch into the elongated thimble tube until deposits are encountered in the thimble tubes;

(b) gripping said drive wire with said rotary slip clutch and thereby rotating said drive wire and cutting tool at 150–200 rpm; and (c) simultaneously feeding said drive wire and attached cutting tool forwardly with limited torque into the thimble tube, and scraping the tube inner wall surface so as to substantially remove deposits from the inner surface of the tube.

* * * * *